United States Patent [19]

Okada et al.

[11] Patent Number: 4,617,037

[45] Date of Patent: Oct. 14, 1986

[54] NITROGEN PRODUCTION METHOD

[75] Inventors: Hidetake Okada, Yokosuka; Satoshi Urata, Ebina, both of Japan

[73] Assignee: Nippon Sanso Kabushiki Kaisha, Tokyo, Japan

[21] Appl. No.: 793,156

[22] Filed: Oct. 31, 1985

[30] Foreign Application Priority Data

Nov. 2, 1984 [JP] Japan ..... 59-232126

[51] Int. Cl.[4] ..... F25J 3/00

[52] U.S. Cl. ..... 62/11; 62/32; 62/38; 62/42; 62/434

[58] Field of Search ..... 62/11, 32, 16, 38, 42, 62/434

[56] References Cited

U.S. PATENT DOCUMENTS

| | | | |
|---|---|---|---|
| 3,126,267 | 3/1964 | Vander Arend | 62/11 |
| 3,818,714 | 6/1974 | Etzbach et al. | 62/11 |
| 3,914,949 | 10/1975 | Matter et al. | 62/11 |
| 4,088,464 | 5/1978 | Bigi | 62/38 |
| 4,099,945 | 7/1978 | Skolaude | 62/38 |
| 4,566,887 | 1/1986 | Openshaw | 62/38 |

*Primary Examiner*—Ronald C. Capossela
*Attorney, Agent, or Firm*—Kane, Dalsimer, Kane, Sullivan and Kurucz

[57] ABSTRACT

A nitrogen production method wherein air is compressed, is removed of water and carbon dioxide contained therein, and is simultaneously cooled to a temperature close to the liquefying point, and the resultant cleaned and cooled air is fed into a rectifying column for rectification so that high purity nitrogen is withdrawn from the rectifying column overhead; and wherein the oxygen-enriched liquid air withdrawn from the rectifying column bottom is expanded and fed into a condensation step wherein it becomes a source of reflux producing cold in the above-mentioned rectifying column, and then a cold is produced by adiabatically expanding the vaporized gas, after which heat exchange with raw air is performed. In this method, there is provided a closed circulating system wherein a circulating gas which is compressed is cooled by heat exchange with a return gas of the circulating gas, and the resultant cooled gas is fed into a reboiler at the bottom of the above-mentioned rectifying column wherein it vaporizes a liquid in the bottom of the rectifying column, and after the compressed circulating gas itself is liquefied through the above described step and expanded, it is fed into the above-mentioned condenser wherein it is vaporized by heat exchange with the high purify nitrogen from the above-mentioned rectifying column, and further the resultant vaporized gas is restored to normal temperature by heat exchange with the above-mentioned compressed circulating gas and is then subjected to recompression for continued circulation.

6 Claims, 3 Drawing Figures

NITROGEN PRODUCTION METHOD

BACKGROUND OF THE INVENTION

This invention relates to a method of producing nitrogen by liquefying and rectifying air by using, for example, a single rectification column, and more particularly to a method of improving the yield of nitrogen by providing a gas circulating system.

A method using a single rectification column is employed most widely as one for producing nitrogen by means of low temperature liquefaction and rectification of air and the process has the construction whose system outline is shown in FIG. 1.

In this process, raw air, compressed to 5 to 10 Kg/cm$^2$ abs by a raw air compressor 1, is fed into an adsorber 4 for removal of carbon dioxide and water contained therein. The resultant cleaned air is then fed into a heat exchanger 6 wherein it is cooled to a temperature close to its liquefying point. Thereafter the cooled air is fed into the bottom portion of a single rectification column 8 having a condenser 11 disposed in a column overhead wherein the rectification of the introduced air is effected so as to separate high purity nitrogen gas from the same at the column overhead as well as a liquid air containing 30 to 40% of oxygen by volume at the column bottom. This oxygen-enriched liquid air passes through a pipe 9, and is expanded and cooled by being reduced to a pressure of 2 to 6 kg/cm$^2$ abs. by an expansion valve 10. The resultant cooled air, fed into a cooled flow channel 11*a* of the above-mentioned condenser 11, is heat exchanged with the above-mentioned high purity nitrogen gas which flows from the overhead of the rectifying column 8 and then branches via a pipe 12 into a flow channel 11*b* of the condenser 11, so that the heat-exchanged nitrogen gas is liquefied and again flows back to the overhead of the single rectifying column 8 as a reflux while the oxygen-enriched liquid air itself is vaporized into a pipe 16.

The oxygen-enriched air at a temperature of −190° to −160° C. which is vaporized in the condenser 11 then enters a flow channel 6*c* of the above-mentioned heat exchanger 6 wherein it is warmed to −160° to −90° C. by heat exchange with the above-mentioned raw air in a flow channel 6*a*. The resultant warmed oxygen-enriched air enters an expansion turbine 17 wherein its pressure is lowered by expansion to produce the required cold. The oxygen-enriched air cooled at −190° to −160° C. enters a flow channel 6*f* of the above-mentioned heat exchanger 6 wherein it provides cold to the raw air flowing in the flow channel 6*a*, whereupon it is discharged out of the system. The remainder high purity nitrogen gas which flows from the overhead of the rectifying column 8 via a pipe 12 and which is branched into a pipe 15 flows through a flow channel 6*b* of the above-mentioned heat exchanger 6, where it is restored to normal temperature and is withdrawn out of the system as a product gas. A nitrogen production method in accordance with this process has advantages in that the entire system requires a less complicated construction and that a product nitrogen gas is not required to be recompressed although the gas withdrawn from the overhead of the rectifying column has merely to be restored to normal temperature, thereby enabling its direct delivery to consumers. However, this method has the disadvantage that electric power consumption becomes large due to the low yield and the large quantity of raw air which needs to be compressed.

From this viewpoint, as a method of reducing these disadvantages and improving the yield of product nitrogen, a method has been proposed wherein the quantity of vaporized gas is increased by a reboiler at the bottom portion of the rectifying column by providing a nitrogen cycle, and simultaneously this circulating nitrogen is fed into the rectifying column overhead to increase the reflux quantity, thereby improving rectification efficiency. In accordance with this method, in the system indicated by the broken line in FIG. 1, product nitrogen gas branches into a pipe 22 and is then compressed to about 15 Kg/cm$^2$ abs. by a circulating compressor 23 and is removed of compression heat. Thereafter the resultant cooled nitrogen gas is fed into a flow channel 6*d* of the foregoing heat exchanger 6 wherein it is cooled to a temperature close to its liquefying point and then, via a pipe 25, into a reboiler or evaporator 26 provided at the bottom portion of the above-mentioned rectifying column 8 for the evaporation of the oxygen-enriched liquid air existing at the bottom portion of the rectifying column 8. The nitrogen gas itself is liquefied and flows through a pipe 27 through an expansion valve 28 whereby it is expanded and cooled, and is then fed into the overhead of the rectifying column 8 from which it flows down in the column as a reflux liquid.

However, the above described method normally requires a high pressure of 15 Kg/cm$^2$ abs. or more as a nitrogen cycle pressure for operating the reboiler 26 and the quantity of gas required for each cycle in order to obtain a certain amount of evaporation or reflux becomes larger due to the use of a region wherein latent heat of evaporation is small. Furthermore, it is difficult to employ a centrifugal type as a compressor which is excellent in continuous running performance for circulating nitrogen, due to the high pressure as described above, and there are also may cases where operators have been forced to use reciprocating or centrifugal type compressors in a region of low efficiency, so that sufficient savings on power consumption are not attained.

This invention aims to improve the low product yield which has been a disadvantage of the conventional single rectifying column method described above, and to allow electric power consumption rate to be reduced.

In view of these and other objects, the present invention provides a nitrogen production method wherein air is compressed, is removed of water and carbon dioxide contained therein, and is simultaneously cooled to a temperature close to the liquefying point, and the resultant cleaned and cooled air is fed into a rectifying column for rectification so that high purity nitrogen is withdrawn from the rectifying column overhead; and wherein the oxygen-enriched liquid air withdrawn from the rectifying column bottom is expanded and fed into a condensation step wherein it becomes a source of reflux producing cold in the above-mentioned rectifying column, and then a cold is produced by adiabatically expanding the vaporized gas, after which heat exchange with raw air is performed.

In this method, there is provided a closed circulating system wherein a circulating gas which is compressed is cooled by heat exchange with a return gas of the circulating gas, and the resultant cooled gas is fed into a reboiler at the bottom of the above-mentioned rectifying column wherein it vaporizes a liquid in the bottom of the rectifying column, and after the compressed circulating gas itself is liquefied through the above described step and expanded, it is fed into the above-mentioned condenser wherein it is vaporized by heat exchange with the high purify nitrogen from the above-mentioned rectifying column, and further the resultant vaporized gas is restored to normal temperature by heat exchange with the above-mentioned compressed circulating gas and is then subjected to recompression for continued circulation.

Since the amount of reflux in the rectifying column can be increased by the provision of the above-described circulating system, the rectification conditions are improved and the amount of raw air becomes smaller as compared with the amount of product nitrogen, that is, the yield of product nitrogen is increase. In this case, the amount of raw air used in the conventional method shown in FIG. 1 which has no circulating system may be substantially equal to the total amount of raw air and circulating gas used in the case of incorporating a circulating system, or alternatively the total amount of raw air and the circulating gas may be smaller. The compression ratio of the raw air compressor is mainly determined in accordance with the pressure required for the product nitrogen, and in the case of the prior art the ratio is normally a value of 6 or more. The compression ratio of a compressor for a circulating system is fundamentally determined in accordance with the temperature difference between the top section and the bottom section of the rectifying column thereof, and the ratio normally becomes a value of 3 or less in view of the temperature difference required for the heat exchange between the reboiler and the condenser as well as the pressure loss in the circulating system. Thus, a fairly large reduction in the electric power needed for the raw air compressor is obtained by providing this circulating system as compared with an increase in electric power for the circulating compressor, thus resulting in a considerable reduction in the total power needed.

However, in the case of FIG. 1 in which the nitrogen cycle is employed the pressure of circulating system must be high and a large amount of circulating gas is needed because the latent heat of nitrogen is small. Thus, in the present invention, the circulating system has a closed cycle and the present invention uses as a circulating gas a gas which has a higher boiling point and larger latent heat at pressurized state than nitrogen.

In the present invention, the circulating gas may be composed of a single or a mixed gas, each having its boiling point at an intermediate point between the respective boiling points of nitrogen and oxygen.

Preferably, the circulating gas is, in the present invention, argon as a single component gas and a gas containing at least two components of nitrogen, argon and oxygen, for example, air as a mixed gas. Such a gas has a higher boiling point and a greater latent heat than nitrogen, thereby enabling the pressure in the circulating system and the circulating amount to be kept at low levels, so that the power consumption of the compressor can be further reduced.

DETAILED DESCRIPTION OF THE PREFERRED EMBODIMENTS

Figure 1:
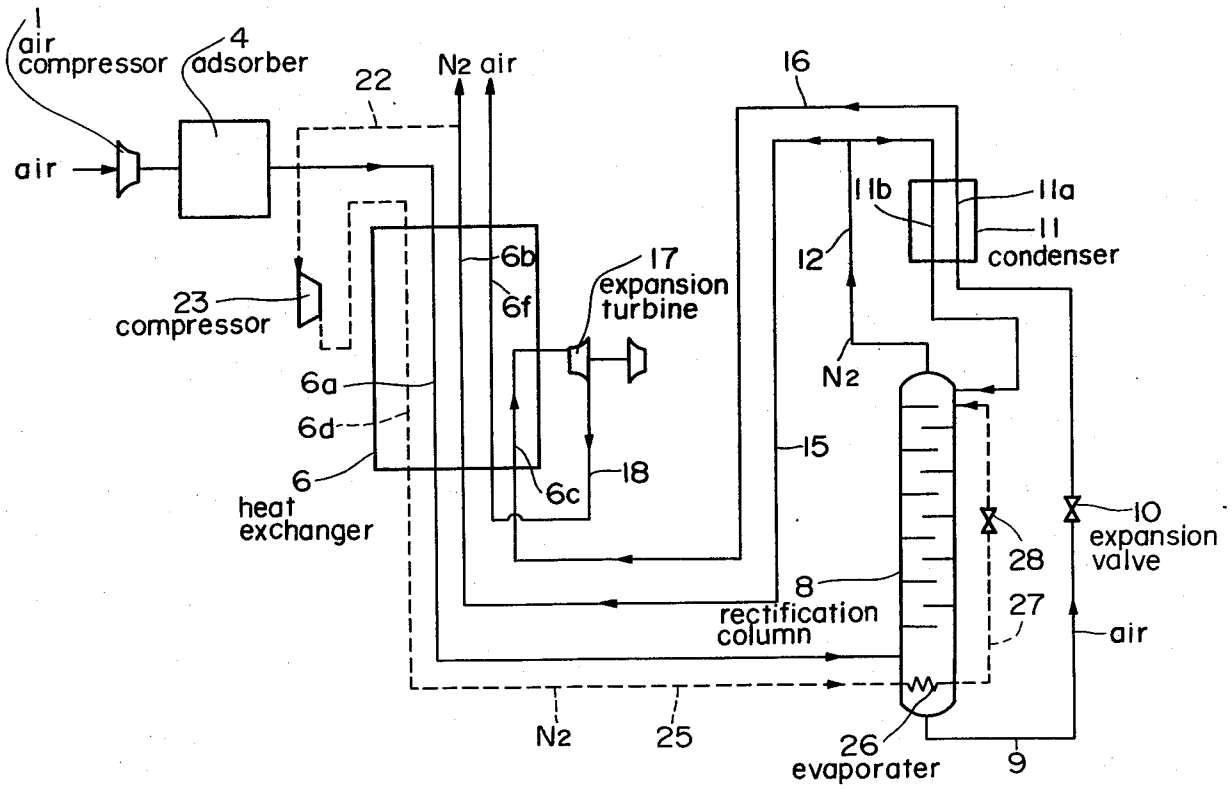
FIG. 1 is a system flow chart of a conventional nitrogen production method.
Figure 2:
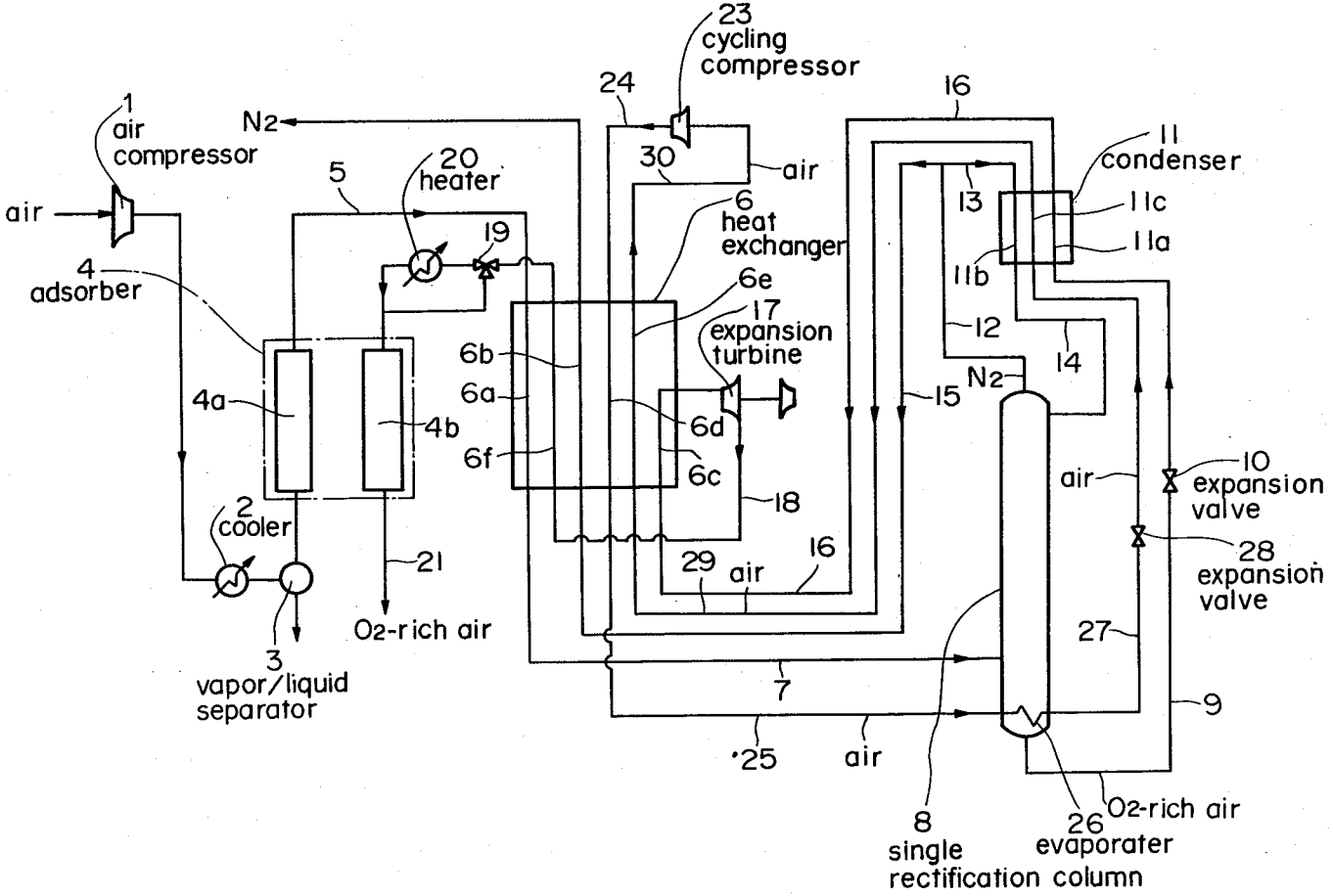
FIG. 2 is a system flow chart showing one embodiment of the nitrogen production method in accordance with this invention.

FIG. 2 is a flow chart showing a nitrogen production system embodying this invention, wherein components identical with those referred to in the method described in FIG. 1 are represented by identical reference numerals for the simplification of description. 12,00 $Nm^3/h$ of air, compressed to 9 ata by the air compressor 1, is fed to a cooler 2 wherein it is cooled. The resultant cooled air enters a liquid-vapor separator 3 wherein water can be separated from the same, and is then fed into an adsorbing cylinder **4*a* during the adsorbing cycle which is constituted by a pair of switchable adsorbing cylinders 4*a* and 4*b* in an adsorber 4 whereby water and carbon dioxide are eliminate by adsorption and the cleansed compressed air enters a conduit 5. This purified compressed air then enters the raw air flow channel 6*a* of the heat exchanger 6 wherein it is cooled to about −168° C. by heat exchange with a countercurrent low temperature gas, and then passes through a conduit 7 to the intermediate stage of the single rectifying column 8. The low temperature purified compressed air entering the rectifying column 8 is rectified and separated in contact relationship with a reflux liquid coming down from above, thereby producing a high purity nitrogen gas at the column overhead and oxygen-enriched air at the column bottom. The overhead high purity nitrogen gas is divided in half after it passes through the conduit 12. One half passes through a conduit 13 into the flow channel 11*b* of the condenser 11 wherein it is liquefied, and is then fed back to the rectifying column 8 through a conduit 14 as a reflux liquid. The remainder 7,000 $Nm^3/h$ of high purity nitrogen gas divided from the overhead gas passes through the conduit 15 into the flow channel 6*b* of the above-mentioned heat exchanger 6 wherein it is warmed to normal temperature, and thereby product nitrogen gas having a pressure of 8 $Kg/cm^2$ abs. can be withdrawn. The liquid air containing about 50 volume % oxygen which is withdrawn by separation at the bottom of the rectifying column 8 passes through the conduit 9 and is reduced in pressure to 5 $Kg/cm^2$ abs. or less and descended in temperature by the expansion valve 10. The cooled liquid air enters the flow channel 11*a* of the above-mentioned condenser 11 wherein it cools and liquefies the countercurrent of the above-mentioned high purity nitrogen gas and itself is vaporized and then flows via a pipe 16, through the channel 6*c* of the above-mentioned heat exchanger 6 wherein it is warmed to −155° C. at 4.3 $Kg/cm^2$ abs. to be fed into the expansion turbine 17. The oxygen-enriched air fed into the expansion turbine 17 is therein descended in temperature by being expanded to 1.3 $Kg/cm^2$ abs. and then, via the pipe 18, through the flow channel 6*f* of the heat exchanger 6 wherein it cools raw air, being itself warmed to normal temperature, and leaving there. In the next place, the resultant warmed air enters a heater 20 through a valve 19 wherein it is heated to 130° C. or more, is then fed into an adsorbing cylinder 4*b* during the regenerating cycle, wherein it regenerates the cylinder 4*b***, and thereafter is exhausted out of the system.

Referring now to the circulating system of this invention, 7,000 $Nm^3/h$ of air containing no water and carbon dioxide circulate through the following route as a circulating gas. Air in a conduit 30, compressed from a pressure of 5 ata to 12.5 Kg/cm$^2$ abs. by the circulating compressor 23, is fed into the flow channel **6*d* of the heat exchanger 6 through a conduit 24 wherein it is cooled to −163° C. The resultant cooled air enters, via the pipe 25, the reboiler 26 provided at the bottom of the above-mentioned rectifying column 8. The oxygen-enriched liquid air at the bottom of the rectifying column 8 is evaporated by the evaporator 26 to the full extent of enabling an improvement in the degree of separation by rectification, and this improves the yield of product nitrogen. On the other hand the circulating compressed air, a heating source for the evaporator 26, is liquefied and then flows through the conduit 27 into the expansion valve 28, wherein it is descended in temperature by being expanded from 12.5 to 5.5 Kg/cm$^2$ abs. The resultant cooled air enters a channel 11*c* of the above-mentioned condenser 11 which it is heat exchanged with the high purity nitrogen gas coming from the top of the above-mentioned rectifying column 8, and then, being vaporized, flows through a pipe 29. This circulating compressed air enters a channel 6*e* of the above-mentioned heat exchanger 6 wherein it is restored to normal temperature The restored air re-enters the circulating compressor 23 through the conduit 30**, and from there recirculates through the same circulating system route as described above, thereby forming a closed cycle.

Figure 3:
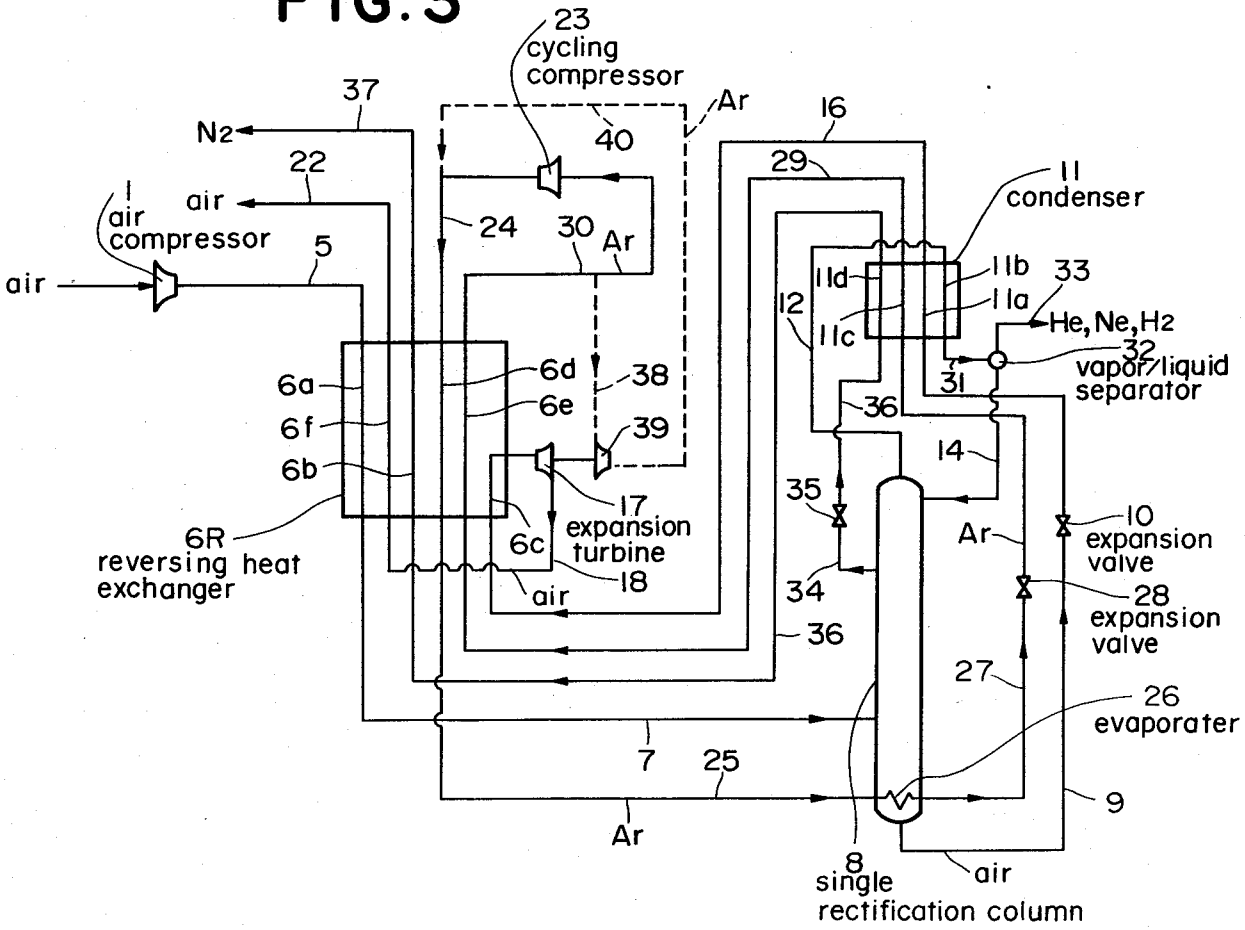
FIG. 3 is a system flow chart showing another embodiment of this invention.

FIG. 3 shows another embodiment of this invention, wherein the purification of raw air is performed not by an adsorber but by a reversing heat exchanger.

In this embodiment as well, description will be made by using the same symbols for components which are identical with those shown in FIGS. 1 and 2. 12,000 Nm$^3$/h of air, compressed to 9 Kg/cm$^2$ abs. by the raw air compressor 1, enters the flow channel **6*a* of a reversing heat exchanger 6R via the pipe 5 wherein it is cooled by a feedback gas, etc., and simultaneously water and carbon dioxide are separated from the cooled air on the heat transfer surface of the flow channel 6*a*, and the resultant purified compressed air of −168° C. is fed to the pipe 7. In the above-mentioned reversing heat exchanger 6R wherein the flow channel 6*a* and a flow channel 6*f* described below are used by alternate switching operation, the water and carbon dioxide separated on the heat transfer surface of the flow channel 6*a* are vaporized and carried by oxygen-enriched air in the next step, and are then exhausted out of the system. The purified low temperature compressed air in the pipe 7, introduced to the intermediate stage of the rectifying column 8, are subjected to rectification and separation in contact with a reflux liquid from the column overhead, thereby producing high purity nitrogen air at the column overhead and oxygen-enriched at the column bottom. The overhead nitrogen gas passes through the pipe 13 into the flow channel 11*b* of the condenser 11 wherein it is cooled and liquefied, and then, via a conduit 31, into a gas-liquid separator 32 whereby a non-liquefied gas containing a high percentage of He, Ne and $H_2$ is separated and withdrawn through the conduit 33, and the other liquefied nitrogen is fed back, as a reflux liquid, to the rectifying column 8 via the conduit 14. Also, 7,000 Nm$^3$/h of high purity liquid nitrogen, withdrawn at a conduit 34 from the rectifying stage positioned several stages lower than the column overhead, is expanded to 7.5 ata by an expansion valve 35 and then enters the flow channel 11*d* of the condenser 11 wherein it is warmed and vaporized. The resultant gaseous nitrogen passes through a pipe 36 into the flow channel 6*b* of the above-mentioned reversing heat exchanger 6R wherein it is warmed to normal temperature, and a high purity product nitrogen gas having a pressure of 7 Kg/cm$^2$ abs. is withdrawn from a pipe 37**.

5,000 Nm$^3$/h of the other portion of liquid air containing 50 percent of oxygen and extracted at the bottom of the rectifying column 8 passes from the pipe 9 and is reduced to a pressure of 5 ata or less by the expansion valve 10. After the resultant liquid air enters the flow channel **11*a* of the condenser 11, wherein it is vaporized, the vaporized air enters the flow channel 6*c* of the reversing heat exchanger 6R, via the pipe 16, wherein it is warmed. The warmed air at 4.3 ata and −155° C. is fed to the expansion turbine 17. In this expansion turbine 17 the above-mentioned oxygen-enriched air is expanded and cooled by being reduced to a pressure of 1.3 Kg/cm$^2$ abs. Again this treated air is fed to the reversing heat exchanger 6R via the pipe 18 wherein it vaporizes and carries the water and carbon dioxide separated on the heat transfer surface by the preceding step, through the flow channel 6*f*, and at the same time cools countercurrent raw air and the like. The oxygen enriched air is warmed to normal air temperature in this heat exchange and is exhausted out of the system via the pipe 22**.

Argon is employed in the circulating system. 5,000 Nm$^3$/h of argon from the pipe 30 is compressed from 2.6 ata to 6.0 Kg/cm$^2$ abs. by the circulating compressor 23, and then, via the pipe 24, through the flow channel **6*d* of the reversing heat exchanger 6R wherein it is cooled from normal temperature to −163° C. The resultant cooled argon flows through the pipe 25 into the evaporator 26 provided at the bottom of the rectifying column 8, and there produces an evaporated gas required for improving the degree of separation in the rectifying column 8. The argon, itself liquefied, is expanded to 2.8 Kg/cm$^2$ abs. by the expansion valve 28 via the conduit 27, and then enters the flow channel 11*c* of the condenser 11 wherein it is vaporized. The resultant vaporized argon enters the flow channel 6*e* of the reversing heat exchanger 6R, via a pipe 29, wherein it is restored to normal temperature, and then re-enters the circulating compressor 23 via the pipe 30. This completes the entire closed circulating system. In this circulating system, a reduction in the power required for driving the circulating compressor 23 can be obtained so that part of the circulating argon from a branch of the pipe 30 is fed to a braking blower 39 of the above-mentioned expansion turbine 17 via the pipe 38. The argon, compressed to 6.0 Kg/cm$^2$ abs. by the blower 39, flows through the pipe 40 into the pipe 24 wherein it joins the argon flowing out of the circulating compressor 23**.

EXAMPLE 1

In a plant using the Ar cycle as shown in FIG. 3, the production of 7,000 Nm$^3$/h of nitrogen gas at a pressure of 7 Kg/cm$^2$ abs. was conducted in accordance with the conditions described in connection with the embodiment of FIG. 3. The operation conditions of the air compressor 1 and the circulating compressor 23 are given in TABLE 1. Excellent results were obtained due to the fact that the total required electric power was 1,560 kW with an electric power consumption rate of 0.223.

COMPARATIVE EXAMPLES 1 & 2

For each comparative example, 7,000 $Nm^3/h$ of nitrogen gas at a pressure of 7 $Kg/cm^2$ abs. was produced under conditions previously described in connection with the prior art in FIG. 1. In Comparative Example 1, the plant indicated by the solid lines in FIG. 1 was used and in Comparative Example 2, the nitrogen cycle indicated by the broken line in FIG. 1 was added to the plant in FIG. 1. The operation conditions of the air compressor 1 and the circulating compressor 23 of the nitrogen cycle are given in TABLE 1. The Comparative Examples 1 and 2 were 2,000 kW and 1,640 kW in total required electric power and accordingly 0.286 and 0.234 in electric power consumption rate, respectively. It will be apparent from these results that a considerable saving of electric power consumption was attained in Example 1.

TABLE 1

| | | Comparative Example | |
|---|---|---|---|
| | Example 1 | 1 | 2 |
| Cycling medium | Ar | — | $N_2$ |
| Air Compressor | | | |
| Compression Rate ($Nm^3/h$) | 12,000 | 18,000 | 12,000 |
| Delivery Pressure ($Kg/cm^2$ abs.) | 9.0 | 9.0 | 9.0 |
| Required electric power (kW) | 1,300 | 2,000 | 1,300 |
| Circulating Compressor | | | |
| Circulating gas | Ar | — | $N_2$ |
| Circulation rate ($Nm^3/h$) | 5,000 | — | 7,800 |
| Suction pressure ($Kg/cm^2$ abs.) | 2.6 | — | 7 |
| Delivery pressure ($Kg/cm^2$ abs.) | 6.0 | — | 15 |
| Required electric power (kW) | 230 | — | 310 |
| Total Required Electric Power (kW) | 1,560 | 2,000 | 1,640 |
| Unite for Power Source ($kWh/Nm^3$) | 0.223 | 0.286 | 0.234 |

What is claimed is:

1. A method for producing nitrogen wherein air is compressed, is removed of water and carbon contained therein, cooled to a temperature close to the liquefying point, is then fed into a rectifying column for rectification and from the overhead of said rectifying column high purity nitrogen is withdrawn; and wherein oxygen-enriched liquid air, fed from the bottom of said rectifying column, is expanded and fed into a condensation step whereafter said expanded oxygen-enriched liquid air is used as a source of reflux producing cold for said rectifying column and adiabatic expansion is effected on the evaporated gas to produce cold, so that heat exchange with raw air is conducted, said method for producing nitrogen being provided with a closed cycle comprising the step of:

compressing a circulating gas;

cooling a compressed circulating gas by heat exchange with a circulating gas fed back into said compressing step;

vaporizing a bottom liquid in said rectifying column by supplying said cooled circulating gas into a reboiler at the bottom of said rectifying column to thereby liquefy the cooled circulating gas;

expanding said liquefied circulating gas;

thereafter feeding an expanded circulating gas into said condensation step to vaporize the same by heat exchange with said high purity nitrogen withdrawn from the rectifying column overhead;

thereafter feeding said vaporized circulating gas into said cooling step before the same is fed back into said compressing step, to heat the same by heat exchange with said compressed circulating gas; and returning said heated circulating gas into said compressing step for circulation.

2. A nitrogen producing method according to claim 1, wherein said circulating gas is composed of a single or a mixed gas, each having its boiling point at an intermediate point between the respective boiling points of nitrogen and oxygen.

3. A nitrogen producing method according to claim 2, wherein said circulating gas is a gas containing at least two components of nitrogen, argon and oxygen.

4. A nitrogen producing method according to claim 3, wherein said circulating gas is air.

5. A nitrogen producing method according to claim 2, wherein said circulating gas is an argon gas.

6. A nitrogen producing method according to claim 1, wherein recompression of the circulating gas heated by said heat exchange is partially performed by recovered power which is generated by said adiabatic expansion.

* * * * *